US007503322B2

(12) United States Patent
Harris

(10) Patent No.: US 7,503,322 B2
(45) Date of Patent: Mar. 17, 2009

(54) METHODS FOR THE TREATMENT OF HIV AND OTHER VIRUSES

(76) Inventor: Michael F. Harris, 1120 Quail Roost Farm Rd., Rougemont, NC (US) 27572

( * ) Notice: Subject to any disclaimer, the term of this patent is extended or adjusted under 35 U.S.C. 154(b) by 1008 days.

(21) Appl. No.: 10/660,429

(22) Filed: Sep. 12, 2003

(65) Prior Publication Data

US 2005/0056285 A1 Mar. 17, 2005

(51) Int. Cl.
*A61G 10/00* (2006.01)

(52) U.S. Cl. ..... 128/202.12

(58) Field of Classification Search ..... 128/200.24, 128/205.26, 205.28, 202.12–202.14, 201.27, 128/204.18; 600/21, 22
See application file for complete search history.

(56) References Cited

U.S. PATENT DOCUMENTS

| | | | | |
|---|---|---|---|---|
| 4,448,189 | A * | 5/1984 | Lasley | 600/21 |
| 4,554,916 | A * | 11/1985 | Watt | 128/203.12 |
| 4,974,829 | A * | 12/1990 | Gamow et al. | 472/94 |
| 5,503,143 | A * | 4/1996 | Marion et al. | 128/202.12 |
| 5,776,048 | A * | 7/1998 | Jo | 600/21 |
| 5,810,795 | A * | 9/1998 | Westwood | 604/305 |
| 6,443,148 | B1 * | 9/2002 | Rodocker | 128/202.12 |
| 6,572,594 | B2 * | 6/2003 | Satterfield et al. | 604/290 |
| 7,198,045 | B2 * | 4/2007 | Risley et al. | 128/202.12 |

FOREIGN PATENT DOCUMENTS

WO WO 96/31217 * 10/1996

OTHER PUBLICATIONS

Pilot Study to Assess the Efficacy of Intermittent Hyperbaric Nitrogen Treatment of Aquired Immunodeficiency Syndrome Medical College of Virginia, Micheal Harris, Mar. 16, 1998, pp. 1-5.*
A Brief Review of Hyperbaric Oxygen for Stroke Rehabilitation, David A.Steenblock, M.S., D.O (printed Jun. 7, 2005, pp. 1-5).*
HBO (Hyperbaric Oxygen) A to Z, printed Feb. 1, 2004, pp. 1-5.*

* cited by examiner

*Primary Examiner*—Steven O Douglas
*Assistant Examiner*—Kristen C Matter
(74) *Attorney, Agent, or Firm*—Rodney L. Sparks

(57) ABSTRACT

A treatment for the persons infected with viruses such as HIV. The method takes advantage of the anesthetic membrane effect brought about by certain gases under pressure. A patient infected with HIV, for example, is placed in a pressurized chamber and exposed to one or more gases under pressure in this environment, molecules or compounds bind to specific attachment sites on surfaces of host cells and on the virus. These attachment sites are the same sites that are required by the virus to attach to host cells during the virus's replication process. The result is that viruses are prevented from replicating. In the case of HIV, without replication, the virus is also prevented from mutating. This deleterious effect on the virus allows the body's immune system to reconstitute itself in numbers sufficient to cause clinical remission. The present method generally comprises the steps of selecting the gases, pressures and duration to be used inside a pressurized chamber, and exposing the patient to the selected conditions.

14 Claims, 9 Drawing Sheets

| Week/Day | Group A |
|---|---|
| 1/1 | Compression to 130 ft/ 25 minutes/ 10% $N_2O$ |
| 1/2 | Compression to 130 ft/ 25 minutes/ 10% $N_2O$ |
| 1/3 | Compression to 130 ft/ 25 minutes/ 10% $N_2O$ |
| 1/4 | Compression to 130 ft/ 25 minutes/ 10% $N_2O$ |
| 1/5 | Compression to 130 ft/ 25 minutes/ 10% $N_2O$ |
| 1/6 | Compression to 130 ft/ 25 minutes/ 10% $N_2O$ |
| 1/7 | Compression to 130 ft/ 25 minutes/ 10% $N_2O$ |
| 2/1 | Compression to 130 ft/ 25 minutes/ 10% $N_2O$ |
| 2/2 | Compression to 130 ft/ 25 minutes/ 10% $N_2O$ |
| 2/3 | Compression to 130 ft/ 25 minutes/ 10% $N_2O$ |
| 2/4 | Compression to 130 ft/ 25 minutes/ 10% $N_2O$ |
| 2/5 | Compression to 130 ft/ 25 minutes/ 10% $N_2O$ |
| 2/6 | Compression to 130 ft/ 25 minutes/ 10% $N_2O$ |
| 2/7 | Compression to 130 ft/ 25 minutes/ 10% $N_2O$ |

Figure 3

| Week/Day | Group B |
|---|---|
| 1/1 | Compression to 72 ft/ 2 hours/ 10% $N_2O$ |
| 1/2 | Compression to 72 ft/ 2 hours/ 10% $N_2O$ |
| 1/3 | Compression to 72 ft/ 2 hours/ 10% $N_2O$ |
| 1/4 | Compression to 72 ft/ 2 hours/ 10% $N_2O$ |
| 1/5 | Compression to 72 ft/ 2 hours/ 10% $N_2O$ |
| 1/6 | Compression to 72 ft/ 2 hours/ 10% $N_2O$ |
| 1/7 | Compression to 72 ft/ 2 hours/ 10% $N_2O$ |
| 2/1 | Compression to 72 ft/ 2 hours/ 10% $N_2O$ |
| 2/2 | Compression to 72 ft/ 2 hours/ 10% $N_2O$ |
| 2/3 | Compression to 72 ft/ 2 hours/ 10% $N_2O$ |
| 2/4 | Compression to 72 ft/ 2 hours/ 10% $N_2O$ |
| 2/5 | Compression to 72 ft/ 2 hours/ 10% $N_2O$ |
| 2/6 | Compression to 72 ft/ 2 hours/ 10% $N_2O$ |
| 2/7 | Compression to 72 ft/ 2 hours/ 10% $N_2O$ |
| 3/1 | Compression to 72 ft/ 2 hours/ 10% $N_2O$ |
| 3/2 | Compression to 72 ft/ 2 hours/ 10% $N_2O$ |
| 3/3 | Compression to 72 ft/ 2 hours/ 10% $N_2O$ |
| 3/4 | Compression to 72 ft/ 2 hours/ 10% $N_2O$ |
| 3/5 | Compression to 72 ft/ 2 hours/ 10% $N_2O$ |
| 3/6 | Compression to 72 ft/ 2 hours/ 10% $N_2O$ |
| 3/7 | Compression to 72 ft/ 2 hours/ 10% $N_2O$ |

Figure 4

METHODS FOR THE TREATMENT OF HIV AND OTHER VIRUSES

BACKGROUND OF THE INVENTION

The present application was originally disclosed in U.S. Provisional Patent Application No. 60/278,141, filed on Mar. 23, 2001, and in Patent Cooperation Treaty application, International Application No. PCT/US02/09416, filed on Mar. 25, 2002. Priority is hereby claimed to those patent applications.

The present invention relates generally to a treatment for viruses, and more specifically to a method that uses a hyperbaric chamber to treat persons infected with viruses such as HIV.

Acquired Immune Deficiency Syndrome (AIDS) is a specific group of diseases or conditions that result from suppression of the immune system related to infection with the Human Immunodeficiency Virus (HIV). A person infected with. HIV gradually loses immune function along with certain immune cells called CD4 T-lymphocytes or CD4 T-cells, causing the infected person to become vulnerable to pneumonia, fungus infections, and other common ailments. When the body loses its immune function, a clinical syndrome develops over time and eventually results in death due to opportunistic infections or cancers. A clinical syndrome is characterized by a group of various illnesses that together characterize a disease. Opportunistic infections are infections by organisms that do not normally cause disease except in people whose immune systems have been greatly weakened.

Infection with HIV does not necessarily mean that a person has AIDS, although people who are HIV-positive are often mistakenly said to have AIDS. The progression from the point of HIV infection to the clinical diseases that define AIDS may take six to ten years or more. This progression can be monitored using surrogate markers (laboratory data that correspond to the various stages of disease progression) or clinical endpoints (illnesses associated with more advanced disease). Surrogate markers for the various stages of HIV infection include the declining number of CD4 T-cells, the major type of white blood cell lost because of HIV infection. In general, the lower the infected person's CD4 T-cell count, the weaker the person's immune system and the more advanced the disease state.

Within one to three weeks after infection with HIV, most people experience nonspecific flu-like symptoms such as fever, headache, skin rash, tender lymph nodes, and a vague feeling of discomfort. These symptoms last about one to two weeks. During this phase, known as the acute retroviral syndrome phase, HIV reproduces to very high concentrations in the blood, mutates (changes its genetic nature) frequently, circulates through the blood, and establishes infections throughout the body, especially in the lymphoid organs. The infected person's CD4 T-cell count falls briefly but then returns to near normal levels as the person's immune system responds to the infection. Individuals are thought to be highly infectious during this phase.

Following the acute retroviral syndrome phase, infected individuals enter a prolonged asymptomatic phase—a symptom-free phase that can last ten years or more. Persons with HIV remain in good health during this period, with levels of CD4 T-cells ranging from low to normal (500 to 750 cells per cubic mm of blood). Nevertheless, HIV continues to replicate during the asymptomatic phase, causing progressive destruction of the immune system. Eventually, the immune system weakens to the point that the person enters the early symptomatic phase. This phase can last from a few months to several years and is characterized by rapidly falling levels of CD4 T-cells (500 to 200 cells per cubic mm of blood) and opportunistic infections that are not life threatening.

During the symptomatic phase, the infected person experiences the extensive immune destruction and serious illness that characterize the late symptomatic phase. This phase can also last from a few months to years, and the affected individual may have CD4 T-cell levels below 200 per cubic mm of blood along with certain opportunistic infections that define AIDS. A wasting syndrome of progressive weight loss and debilitating fatigue occurs in a large proportion of people in this stage. The immune system is in a state of severe failure. The person eventually enters the advanced AIDS phase, in which CD4 T-cell numbers are below 50 per cubic mm of blood. Death due to severe life-threatening opportunistic infections and cancers usually occurs within one to two years.

Researchers have known since 1984 that HIV enters human cells by binding with a receptor protein known as CD4, located on human immune-cell surfaces. HIV carries on its surface a viral protein known as gp120, which specifically recognizes and binds to the CD4 protein molecules on the outer surface of human immune cells. Any human cell that has the correct binding molecules on its surface is a potential target for HIV infection. However, it is the specific class of human white blood cells called CD4 T-cells that are most affected by HIV because these cells have high concentrations of the CD4 molecule on their outer surfaces. HIV replication in CD4 T-cells can kill the cells directly; however, the cells also may be killed or rendered dysfunctional by indirect means without ever having been infected with HIV. CD4 T-cells are critical in the normal immune system because they help other types of immune cells respond to invading organisms. As CD4 T-cells are specifically killed during HIV infection, no help is available for immune responses. General immune system failure results, permitting the opportunistic infections and cancers that characterize clinical AIDS.

The Centers for Disease Control and Prevention (CDC) in Atlanta, Ga., has established an authoritative definition for the diagnosis of AIDS. In an HIV-positive individual, the CD4 T-cell count must be below 200 cells per cubic mm of blood, or there must be the clinical appearance of an initial AIDS-defining opportunistic infection, such as PCP (Pneumocystis Carinii Pneumonia), oral candidiasis (thrush), pulmonary tuberculosis, or invasive cervical carcinoma (cancer of the cervix in women).

Traditional treatments for AIDS include antiviral drugs that attack HIV by exploiting vulnerable spots in the viral replication cycle. One target is the process of reverse transcription—that is, the conversion of the viral ribonucleic acid (RNA) into deoxyribonucleic acid (DNA)—that HIV must undergo to be infectious. Reverse transcription is a process unique to retroviruses and is performed by the viral enzyme reverse transcriptase (RT). One class of anti-HIV drugs, known as nucleosides, are all RT inhibitors. Five nucleosides are currently licensed by the U.S. Food and Drug Administration (FDA): zidovudine (Retrovir, AZT), didanosine (Videx, ddl), zalcitabine (Hivid, ddC), stavudine (Zerit, d4T), and lamivudine (Epivir, 3TC). These drugs work as DNA-chain terminators. Because the drug appears to be a normal nucleotide base (the building block of DNA), the RT enzyme mistakenly inserts the drug into the growing viral DNA chain. Once the drug is inserted, no additional DNA bases can be added, and therefore viral DNA synthesis is terminated. Although the nucleosides are more likely to interact with the viral RT enzyme, they also can be incorporated by the enzyme responsible for normal cellular DNA synthesis in the person receiving the drug, leading to toxicity (poisoning) and side effects. Such drug incorporation is usually observed in rapidly dividing cell types, such as the cells of the bone marrow, spongy tissue filling the cavities within bones.

Another problem with traditional treatments is the emergence of drug-resistant forms of HIV in people receiving these drugs. Studies on early treatment of HIV infection with AZT have presented contradictory results as to whether such early treatment prolongs life. Because HIV replicates rapidly and mutates frequently during the earliest period of infection, an HIV-infected person carries many different strains of HIV, some of which may be drug-resistant. The limited variety of HIV in the early stage is thought to make it more susceptible to AZT and related drugs. Although RT inhibitors were never considered a cure for HIV infection, it was hoped that they would slow the progression of AIDS, and AZT has been shown effective in reducing HIV transmission from pregnant women to their babies. However, the clinical benefit of RT inhibitors when used alone has been largely disappointing; they have extended the lives of people with AIDS by only about six months.

Another traditional treatment for AIDS is a class of anti-HIV drugs known as protease inhibitors, approved by the FDA in December 1995. Protease inhibitors work by crippling a key viral enzyme called protease, which is vital to the reproduction of HIV in the later stages of its replication cycle. After HIV replicates—that is, makes copies of its own protein components—these proteins must be cut to specific sizes before they can assemble into a mature virus. Protease is responsible for trimming the new HIV proteins to their required dimensions. When protease is blocked—or inhibited—the proteins are not cut and the defective HIV cannot infect new cells. The first protease inhibitor drug, saquinavir (Invirase), was approved for use in combination with nucleoside drugs such as AZT. In March 1996 two additional drugs, ritonavir (Norvir) and indinavir (Crivaxin), were rapidly approved for use alone or in combination with nucleosides. A fourth drug, nelfinavir (Viracept), was approved by the FDA in March 1997 for both adult and child use. Preliminary results from American and European studies indicate that these drugs cause dramatic increases in the number of CD4 T-cells and decreases in the amount of virus in the blood. These results are about two to three times more powerful than those seen with the nucleoside drugs. Researchers cautioned that new studies also show that HIV can quickly develop resistance to these new drugs, at least when they are used alone. However, researchers suspect that the resistance can be delayed when the agents are combined with other anti-HIV drugs—for example, the nucleosides. The most effective treatment against HIV is currently considered to be a combination of three drugs taken together—two nucleoside RT inhibitors and one protease inhibitor. Although these drug combinations may cause severe side effects (such as diarrhea, abdominal cramps, and anemia), when taken properly they can reduce blood levels of the virus to undetectable levels. Each drug must be taken according to specific guidelines, however, and one missed dose can allow the virus to quickly mutate to a strain that resists the drugs. These drug combinations can also consist of two nucleoside RT inhibitors and one non-nucleoside RT inhibitor, a new class of anti-HIV drug first recommended for approval by the FDA in June 1996. These drugs work similarly to nucleoside RT inhibitors in that they bind to the HIV reverse transcriptase enzyme. However, they do not compete with other nucleosides for binding sites. The first drug of this type to be developed was nevirapine (Viramune), which was approved by the FDA in April 1997. A second non-nucleoside RT inhibitor, delavirdine (Rescriptin), is currently available only in test settings. Both drugs are effective only when taken with nucleoside RT inhibitors and they should not be used with protease inhibitors. "Acquired Immune Deficiency Syndrome," *Microsoft Encarta* 98 *Encyclopedia,* 1993-1997.

The preferred treatment for viruses such as HIV, disclosed in this application, involves the use of a hyperbaric chamber. Hyperbaric chambers are specialized enclosures that can be pressurized to greater than 1 atmosphere; the atmospheric pressure at sea level. Hyperbaric chambers are perhaps best known as being a cure for the bends; a condition that strikes SCUBA divers when they rise to the surface too fast. Pressure on underwater divers doubles at a depth of approximately 30 feet. The increased pressure of each gas component, which the diver is breathing, at depth means that more of each gas will dissolve into the blood and body tissues, a physical effect predicted by Henry's Law, which states that the amount of gas dissolving into any liquid or tissue with which it is in contact is proportional to the partial pressure of that gas. Inhaled gases are in close contact with blood entering the lungs. Hence, the greater the partial pressure of any inhaled gas, the more that gas will diffuse into the blood.

Unlike oxygen and carbon dioxide, nitrogen ($N_2$) is inert; it is not metabolized by the body. At sea level the amount of $N_2$ inhaled and exhaled is the same. This is not the case for $O_2$ and $CO_2$, which are not inert gases but instead participate in metabolism; as a result less $O_2$ is exhaled than inhaled, and more $CO_2$ is exhaled than inhaled. When breathing compressed air at depth, more gas molecules of air are inhaled because the air is at a higher pressure, and hence denser, than at sea level. Both the pressure and amount of inhaled nitrogen and oxygen are greater at depth than at sea level. Most of the extra oxygen is metabolized and doesn't pose any problem at recreational depths. But the extra nitrogen that is inhaled has nowhere to go but into the blood and tissues, where it is stays in the gas phase ("dissolved") at the higher pressure, until the ambient pressure is reduced; then it starts to dissolve back out, and is excreted in the exhaled air. Two important problems relate to the increased quantity and pressure of nitrogen from inhaling compressed air; nitrogen narcosis and decompression sickness. Although both problems are related to too much nitrogen, they are distinct. Nitrogen narcosis is a function of the increased pressure of the gas and is only a problem as tong as that pressure remains elevated. Thus nitrogen narcosis is solely a function of depth. Because the problem is related only to depth, it can be cured by ascent or reduction in pressure.

Decompression sickness (DCS) is not due to the pressure of nitrogen at depth per se, but instead to the formation of bubbles as dissolved nitrogen comes out of the tissues with ascent. Since bubble formation is in part related to the total amount of nitrogen in the tissues, the dive time or time at pressure is important (the longer the dive, the more nitrogen enters the tissues, up to a point). Thus DCS is a function of depth and duration of the dive and, at least among recreational divers, is a far more common problem than nitrogen narcosis. Unlike nitrogen narcosis, DCS can lead to permanent physical impairment. In 1878 Paul Bert, an eminent French physiologist, published his classic work Le Pression Barometrique, in which he recommended slow ascent in order to prevent the bends. Over the next decade "Caisson Disease", or DCS, became a recognized malady, and slow ascent from the caisson's high pressure was accepted as the method of prevention. The symptoms of DCS are especially apt to come on if a change from a high pressure environment to ordinary atmospheric pressure is quickly made. They may supervene immediately on leaving the high pressure environment, or they may be delayed for several hours in the mildest form there are simply pains about the knees and in the legs, often of great severity, and occurring in paroxysms. Abdominal pain and vomiting are not uncommon. The legs may be tender to the touch, and the patient may walk with a stiff gait. Dizziness and headache may accompany these neuralgic symptoms, or may occur alone. In the severe form of DCS there is paralysis both of motion and sensation, usually paraplegia (paralysis below the trunk) but the paralysis may be general, involving the trunk and arms. In the most extreme instances the patient rapidly becomes comatose and death occurs in a few hours. The explanation of this condition is still not fully understood. It has been suggested that the symptoms are due to the liberation in the spinal cord of bubbles of nitrogen which have been absorbed by the blood under the high pressure. A large majority of the cases recover. The severe neuralgic pains often require morphine. Inhalations of oxygen and the use of compressed air have been advised. When paraplegia develops the treatment is similar to that of other forms. Microsoft Encarta® 98 Encyclopedia. 1993-1997 Microsoft Corporation.

Decompression sickness (DCS) arises when excess nitrogen leaving tissue forms bubbles large enough to cause symptoms. Size of bubbles is important, since small bubbles can often be found in divers with no symptoms. Detection of bubbles is commonly accomplished with Doppler ultrasound. DCS arises when the pressure gradient for nitrogen leaving the tissues is so great that large bubbles form, probably by coalescence of many smaller bubbles. Large bubbles within tissues and the circulation system cause the symptoms and signs of decompression sickness. When nitrogen bubbles leave the tissues they first enter capillaries and then the veins (venous circulation). Nitrogen bubbles travel in the venous circulation to the lungs, but then are trapped in the lung capillaries because the bubbles are larger than the tiny diameter of the capillaries. Once trapped, the bubbles break up and the nitrogen gas is exhaled. As a result of being trapped and exhaled, the bubbles do not enter the arterial circulation. Blockage of blood flow to joints by the bubbles causes pain, which is "the bends." Blockage of blood flow to nervous tissue can cause paralysis or stroke. Neurologic symptoms are particularly common because nitrogen is highly soluble in fat (five times more than in blood), and dissolves readily in the fatty myelin sheaths that surround nerves. As the diver ascends nitrogen comes out of these nerve sheaths; if too much nitrogen is in these nerve sheaths at the beginning of ascent, bubbles may form and compress nerves even before they enter the venous circulation. Apart from compressing nerves and blocking circulation, bubbles can also set off certain chemical reactions, collectively called an "inflammatory response." An inflammatory response is marked by release of certain protein compounds. Although this process is poorly understood in decompression sickness, it is important to note that chemical changes do occur in the blood of DCS patients, and that some symptoms are not simply the result of nerve compression or circulation blockage.

The only effective treatment for DCS is recompression in a hyperbaric chamber, and the sooner the better. Hyperbaric chambers can be found in or near most large U.S. cities. All manifestations of DCS are potentially reversible if the victim can be quickly recompressed in a chamber. Recompression squeezes the nitrogen bubbles to a smaller size and allows a slower and safer egress of nitrogen from the tissues. Delay in hyperbaric therapy may result in permanent paralysis. Treatment is recommended even if symptoms abate or clear before the patient reaches the chamber. This is because bubbles may still be present in the circulation, and could lead to a more devastating problem later on.

The present method may use of gases, including air, and anesthetics, such as nitrous oxide, in a hyperbaric chamber. Nitrous oxide was first used as an anesthetic in 1844, by the American dentist Horace Wells. In 1842 the American surgeon Crawford Long successfully used ethyl ether as a general anesthetic during surgery. Many other general anesthetics have since been discovered. Ether has largely been abandoned because of its dangerous side effects and flammability. Some anesthetics, such as barbiturates and halothane, act by depressing the central nervous system, whereas others, such as nitrous oxide and enflurane, induce amnesia and dissociation.

Other gases, besides air, that may be used in the chamber include the Noble Gases, also called inert gases, which consist of six gaseous chemical elements, which are in order of increasing atomic weight, helium, neon, argon, krypton, xenon, and radon. For many years chemists believed that these gases, were inert—that is, that they would not enter into chemical combinations with other elements or compounds because their outermost shells were completely filled with electrons. This is now known not to be true, for at least the three heaviest inert gases—krypton, xenon, and radon. The forces between the outermost electrons of these three elements and their nuclei are diluted by distance and the interference of other electrons. The energy gained in creating a xenon or radon fluoride is greater than the energy required for promotion of the reaction, and the compounds are chemically stable, although xenon fluorides and oxides are powerful oxidizing agents.

As mentioned above, AIDS is almost always fatal within a few years of a significant CD4/CD8 T lymphocyte depression to less than 200. The general concept of the final common pathway for HIV pathogenesis is based on the suppression of CD4/CD8 T lymphocyte ratio. As discussed above, the current best therapeutic approaches to the treatment of AIDS are based on maintaining the CD4/CD8 ratio by preventing HIV replication. Despite these improvements, however, HIV may evolve resistance to all antiretroviral agents. The therapeutic options for patients failing all antiretroviral treatment are very limited and may include only participation in an investigational trial and prophylaxis for opportunistic infections.

There is a need for effective control of T cell responses as a therapeutic strategy for interfering with the pathogenesis of HIV induced immune deficiency. Several groups have demonstrated that AIDS represents the loss of a T cell lymphostasis wherein the decline in CD4 effector cells leads to an immunodeficient state due to an imbalance in CD4/CD8 lymphocyte availability. Based on this, if it were possible to stimulate CD4 T cell recovery and normalize CD4/CD8 ratios, reversing the AIDS-induced suppressor cell dominance, clinical remission could be accomplished. In an attempt to accomplish this goal, research in the present concept based on the biological effects of molecular gases on cell membranes began.

SUMMARY OF THE INVENTION

It has been shown that the utilization of nitrogen, or other inert gases, at increased pressure: inhibits HIV viral replication; changes lymphocyte cell membrane fluidity; and, leads to stabilization of immune responsiveness. It was observed that enriched nitrogen increased CD4/CD8 ratios, preserved lymph node architecture, and improved physical conditions of patients. Nitrogen changes the conformation of cell membrane lipids and proteins and this is used to prevent the attachment of viruses to their host cell surface receptor leading to an increase in the CD4/CD8 ratios in patients with viruses similar to the AIDS virus.

A present method is for preventing the reproduction of a virus inside a person infected with the virus. A pressurized chamber is used to force an atom, molecule or compound (compound) from one or more gases that fill the chamber, or from within a patient's own body, to bind to specific sites on cell walls of living cells. The compounds may also bind to attachment sites on the virus itself. The compounds, once in place, prevent the virus from replicating by blocking attachment sites that the virus uses to attach to host cells. The first step in the present method is to select the one or more gases to be used. Air is one of the gases that may be used. Other gases include nitrogen, the inert gases, nitrous oxide and other anesthetics. For gases other than air, in the preferred embodiment the gases make up 5% or more of the gases in the pressurized chamber. The second step is to select the pressure to be used inside the chamber. This step is related to the third step of selecting the duration of time for the patient to be exposed at pressure. Generally, the higher the pressure to be used, the lower the duration of exposure. An exemplary pressure and duration is a pressure equal to a diving depth of 130 feet and remaining at that pressure for 25 minutes. The forth step is to expose the patient to these selected conditions inside the pressurized chamber. Exposure to the selected conditions may be repeated two or more times. In an exemplary embodiment, the present treatment is repeated daily for 14 days. An exemplary pressure range is between 35 and 165 ft. An exemplary range for number of daily repeated exposures is between 2 and 30 days.

An optional step in the present method is to create exposure charts for each patient. The exposure chart can be based on the severity of the patient's illness and includes information such as the time-period that the person is to be exposed to the selected gases at the selected pressures, and the amount of repetition. Since today's hyperbaric chambers can hold more than one person, the present method may also be used to treat more than one patient at a time in the chamber.

It is an object of the present invention to block viral replication inside the body of a person infected with the virus.

It is another object of the present invention to increase the ratio of CD4/CD8 lymphocytes in the immune system of an infected person.

BRIEF DESCRIPTION OF THE DRAWINGS

The invention of the present application will now be described in more detail with reference to the accompanying drawings, given only by way of example, in which:

FIG. 3 is an exemplary pressure and duration chart;

FIG. 4 is another exemplary pressure and duration chart;

DETAILED DESCRIPTION OF THE INVENTION

It has been proposed as a result of anecdotal reports of HIV infected divers and recent animal studies that repeated exposure to compressed air may prevent suppression of the CD4/CD8 lymphocyte ratio and thereby be effective in the treatment of AIDS. AIDS represents the loss of a T cell lymphostasis wherein the decline in CD4 effector cells leads to an immunodeficient state due to an imbalance in CD4/CD8 lymphocyte availability. The present method makes it possible to stimulate CD4 cell recovery and normalize CD4/CD8 ratios, reversing the HIV induced suppressor cell dominance thereby providing clinical remission. It is therefore within the scope of this patent application that repeated exposure of AIDS patients to compressed air or nitrogen/oxygen mixtures at pressures up to 7 atmospheres absolute (200 feet of seawater equivalent) will treat and prevent the progression of Acquired Immune Deficiency Syndrome (AIDS).

Figure 1:
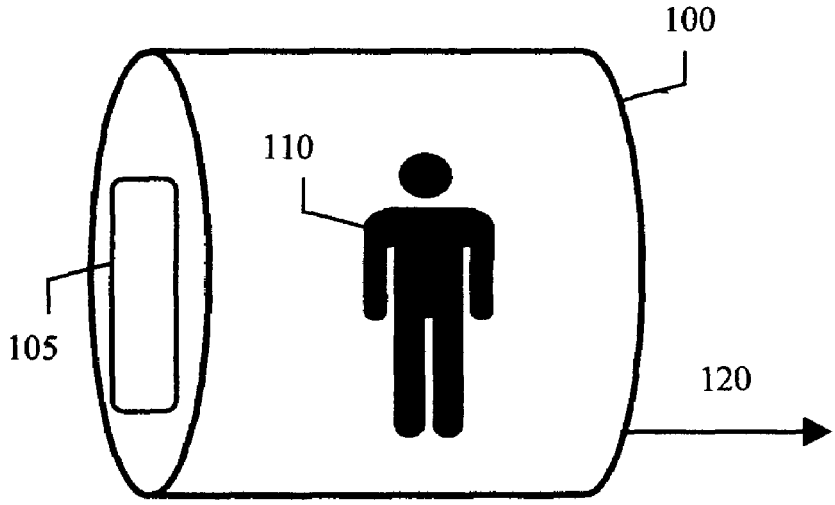
FIG. 1 shows one patient being treated using the present method.

FIG. 1 represents a patient 110 receiving treatment for aids using the preferred embodiment of the present method. In this example, patient 110 is a person infected with HIV. As discussed above, viruses must infect living cells in order to replicate and survive. Because of HIV's ability to rapidly mutate, the virus is able to elude attack from the body's main defenses and eventually overwhelms the immune system. In the first step of infecting a living cell, HIV attaches to a specific attachment site on the cell's wall. The present treatment takes advantage of the anesthetic membrane effect brought about by certain gases under pressure, wherein elements or compounds such a nitrogen or another gas are caused to attach to attachment sites. In a hyperbaric chamber 100 compounds, such as nitrogen, bind to specific attachment sites on cell walls and on the virus and prevent the virus from attaching to an intended host. In the case of HIV, the intended hosts include CD4 T cells, which play an important role in the body's immune system.

Our studies have shown that nitrogen at increased pressures is effective in maintaining or increasing CD4/CD8 ratios in a murine leukemia virus mouse model which bears a striking similarity to human AIDS. The success of the present method is related to the narcotic properties of the nitrogen gas on cell membranes. Its narcotic effect in diving is well known, and the mechanism for inducing narcosis also, is believed to be due to conformational changes induced in cell membranes by the nitrogen molecules in the lipid-protein cell membranes of the brain. This conformational change is well known as the proposed mechanism for a number of general anesthetics by affecting the release of neurotransmitters and propagation of nerve impulses in the brain. Nitrogen is in fact a very weak anesthetic and needs pressure to provide sufficient molecules to have such an anesthetic effect. Another weak anesthetic is nitrous oxide. This gas is somewhat stronger than nitrogen. However it has been noted that with nitrous oxide and oxygen at atmospheric pressure (i.e. 760 mmHg) many subjects do not even lose consciousness with a 90% $N_2O$ and 10% $O_2$ mixture. However, increasing the pressure to 1520 mmHg or 2 atmospheres absolute (the distribution is 1368 mmHg $N_2O$+ 125 mmHg oxygen) resulted in deep anesthesia.

Without attaching to and infecting a host cell the virus is prevented from replicating. When the virus is prevented from replicating, the virus is also prevented from mutating. This leads to a reduction in the total number of viruses and reduces the number of different mutant strains that need to be identified, or recognized, by the immune system before they can be attacked. Both of these factors allow the body's immune system to gain an upper hand on the virus and eventually return to normal CD4/CD8 ratios. The present method uses a pressurized chamber, such as hyperbaric chamber 100, to assist in the delivery of a gas molecule, or compound, to within the patient's body. The gas, when inhaled by the patient under pressure, is distributed to many areas within the patient's body. In the case of nitrogen, the molecule is attracted to specific attachment sites on cell walls of cells within the body and to attachment sites on the virus itself, in the case of HIV. These attachment sites have been shown to be the same attachment sites that the virus needs in order to attach to a host cell and replicate.

Hyperbaric chamber 100 is the same pressurized chamber that is well known in the deep see diving community and is currently best known as a cure for the bends. Chamber 100 has an airtight door 105 through which the patient enters and exits the chamber. Monitoring link 120 provides patient vital signs, such as pulse rate and blood pressure, as well as other information to administrators outside of chamber 100. Optionally, a 12-lead electrocardiogram may be used to collect information on the patient. Preferably, the patient is screened before and after treatment in chamber 100. Exemplary screening tests include: a blood sample for HIV-1 RNA and CD4/CD8 ratio; CBC; a physical exam; serum pregnancy test (for women of childbearing potential); and, a urinalysis. Other patient information that is collected includes height, body weight, and temperature. Each blood sample obtained can be drawn from a vein in the arm using sterile technique. The amount of blood collected need only be about 4 tablespoons (120 μl). The blood sample will permit CD4+/CD8+, CBC measurements, and complement. In addition the subjects will be certified by a physician as fit to dive and vital signs (PR, BP, body weight, T) taken. After exposure, precordial ultrasonic Doppler measurements will be made to listen for the presence of bubbles in the blood resulting from decompression.

The following safety precautions may also be enforced on patient 110 prior to each exposure in chamber 100. Patients will be encouraged to refrain from the use of tobacco, alcohol or caffeine within 24 hours of reporting to the clinic or hyperbaric chamber. The following medications may be permitted: non-steroidal anti-inflammatory drugs as required; prophylactic medications for *P. carinii* pneumonia and for *M. avium,* including azithromycin (in accordance with current CDC recommendations); antibiotics for bacterial infections; and, medications for symptomatic treatment such as antipyretics, analgesics and antiemetics. The following medications are preferably prohibited, therapeutic vaccines; immunodulators (Remune, IL-2); any vaccine (HIV, flu, etc.); chemotherapy; and, any investigational therapy.

Figure 2:
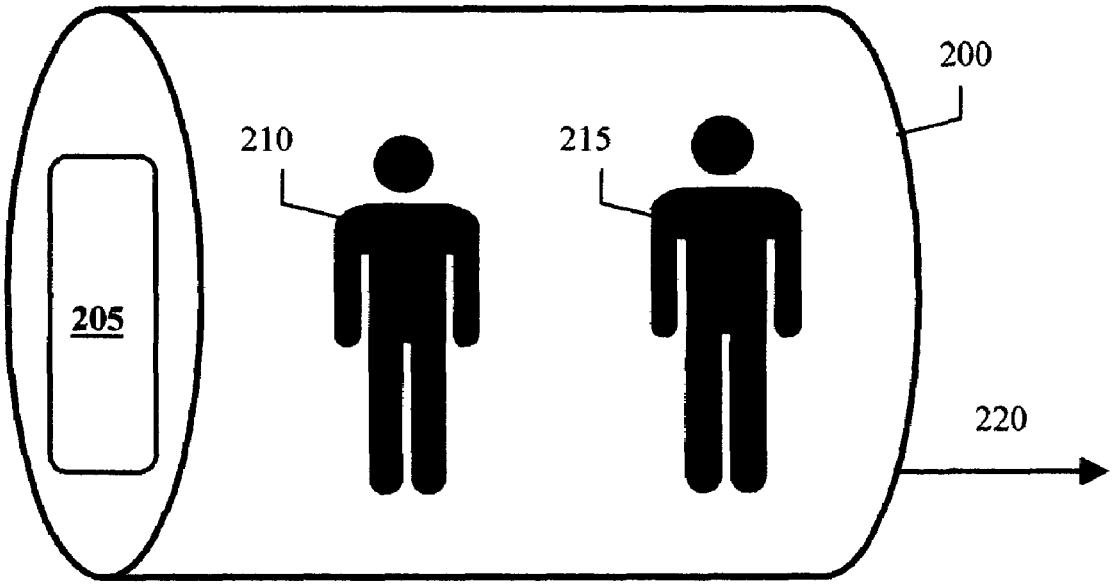
FIG. 2 shows two patients simultaneously being treated with the present method.

Referring to FIG. 2, patients 210 and 215 are simultaneously being treated using the preferred embodiment. Hyperbaric chamber 200 is larger than chamber 100 and is capable of holding two or more people during pressurization. Since newer chambers exist that can hold eighteen people it is understandable that the number of patients that can be treated simultaneously in the same chamber is only limited by the capacity of the chamber. Again, door 205 is used to enter and exit chamber 200 and monitoring link 220 provides information on the patients and the status of the chamber to others outside chamber 200. Chamber status information includes pressure inside the chamber 200 and the composition of the gases inside the chamber. Pressure inside chamber 200 can be measured in atmospheres (atm or ata) or by the equivalent water pressure at a specified depth in feet (ft). The composition of the gases inside the chamber may consist of only air. Since nitrogen makes up four fifths of air by volume, surface air alone has been shown to be a gas for adequate delivery of nitrogen. Other gases that may be used in chambers 100 or 200 during treatment include the inert gases, including helium and argon, nitrogen, and nitrous oxide and other anesthetics.

The present method was influenced by anecdotes of deep sea professional and recreational air divers in Puerto Rico infected with HIV and symptomatic from AIDS who became asymptomatic after being saturated with nitrogen under hyperbaric pressure. Several such individuals have had lasting remission with no further recurrence of symptoms for more than eight years following diving with compressed air. This clinical response has been shown to be associated with repetitive nitrogen adsorption in critical body tissues and lymphocytes during deep sea diving. Nitrogen is readily soluble in the lipid bilayer of cells and changes membrane physiochemical properties under pressure. This leads to physiological effects, particularly in the central nervous system, including nitrogen narcosis and anesthetic membrane effects mediated by conformational changes at hydrophobic binding sites on cell membranes. Because of the membrane effects, hyperbaric nitrogen at raised pressures has been shown to inhibit HIV attachment to membranes, thereby slowing replication, altering HIV's inhibition of immune function and reducing the fast mutation rate of the virus.

FIG. 3 shows an exemplary exposure chart for a patient. Such a chart may be developed for each patient based on different factors such as the current stage of the patient's disease. The exposure chart shows the pressure the patient will be exposed to, the length of time the patient will remain at that pressure, and what gas or gases the patient will be exposed to in the chamber. The chart of FIG. 3 also shows how often this exposure will be repeated. In this case, the exposure is repeated daily for a total of 14 days. Under pressure, nitrogen causes membrane changes that block viral replication. This membrane effect is believed to continue for some period of time after decompression. The result being the normalization of the body's immune system, specifically the CD4/CD8 ratio. Due to the time required for compression and decompression of the chamber, the time that the patient is required to stay inside the chamber will be longer than the time period shown on the chart of FIG. 3. The Canadian Defense and Civil Institute for Environmental Medicine, Toronto tested and approved decompression tables are used to dictate the rate of decompression. This, or another, standard table can also be used to provide a further safety factor. For example, in a session involving a pressurized chamber exposure of 125 ft for 25 mins.'s, the decompression rate for 130 ft for 30 min.'s can be used in the decompression stage.

FIG. 4 is another exemplary exposure chart listing information critical for the present method. Such charts would of course include patient information and may optionally include other information. According to the exposure chart of FIG. 4, the patient will be exposed to 10% nitrous oxide at 72 ft of pressure for 2 hours. This exposure session will be repeated on a daily basis for 21 days. The charts of FIGS. 3 and 4 are exemplary only. Other pressures, durations, and repetition lengths may be used and will at least partially be based on the patient's condition. A contrast of the charts of FIGS. 3 and 4 shows the inverse relationship between pressure and duration. In FIG. 3, high pressure is used for a relatively short duration. In FIG. 4, a relatively low pressure is used for a longer duration. Thus, shorter sessions can be achieved by using higher pressures. However, due to the increased risk of decompression sickness, pressures above 165 ft are not likely to be used. Although the same pressure is used for every session in FIG. 4, different pressures may also be used for different sessions. Similarly, different gases and different durations may also be used in different sessions.

Figure 5A:
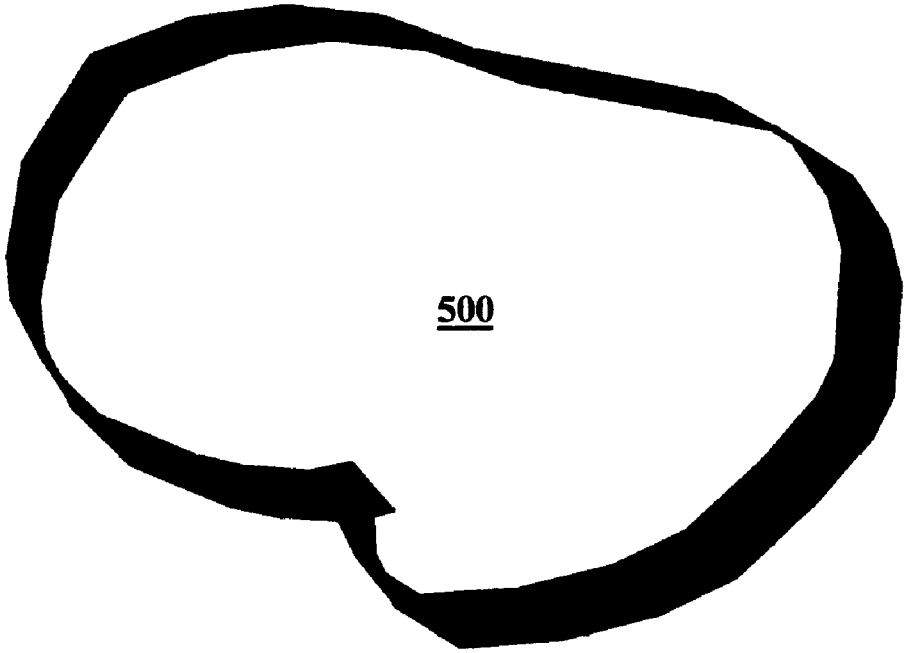
FIG. 5A represents a lymph node infected with a retrovirus.

FIG. 5A represents the cross section of an actual lymph node removed from a mouse that took part in a study of the present method. The lymph node of FIG. 5A was take from a mouse in the control group of the study, i.e., the mouse did not receive the present treatment. All of the mice in the study, including the control group, were infected with murine leukemia virus (MULV), a virus that is remarkably similar to HIV. As a result of the observations on divers in Puerto Rico, it was decided to first test this concept in murin leukemia virus-MULV mice exposed to increased pressures of nitrogen at a depth of 72 feet for 2 hours 6 days per week for 3 weeks. FIGS. 5A & B show the significant reduction in lymph node size in mice using the preferred embodiment of the present method. The study showed the effects of hyperbaric conditions on a murine leukemia virus—MuLV model (AKR-J strain of mice). The murine model, AKR-J strain of mice which are viremic from birth, were used to test the hypotheses. The animal model was chosen because of its striking similarities to human AIDS. If treatment of the mice is successful, it was reasonably expected that the same or similar method would be a successful treatment for HIV infection. Both diseases exhibit equivalent changes in immune functions, T-cell differentiation, cytokine production, disease resistance, and oxidative stress. The mice were separated at random into four groups of 12 mice in each group. Group 1 was control. Group 2 was exposed to air at sea level pressure. Group 3 was exposed to $N_2$ and Group 4 to $O_2$ under the following conditions. The mice were placed in a small (5.88 cubic feet), temperature controlled hyperbaric chamber and compressed with Air, N2+6.5% O2 or 100% O2. Groups were taken separately to a pressure of 72 feet of seawater. The animals reached maximum treatment pressure in 6-7 minutes and remained at this pressure for 2 hours. They were then returned to normal barometric pressure at a rate of one foot per minute (72 minutes). This process was performed each day for six days a week for three weeks. The control group of animals (Group 1) was exposed to normal surface conditions for the same period of time. The entire control group survived the study with no problems, as did those breathing air or nitrogen. In the oxygen group, however, two of the mice died. The animals in the nitrogen and air groups also appeared physically more healthy than the control and oxygen groups. Spleen and lymph node sizes were much bigger in the latter two groups.

Cytological and histological measurements. Pre- and post-flow cytometry (FACS) analysis was performed on samples of orbital blood from 10 animals in each group labeled with anti-mouse CD4/CD8 fluorescence markers. Animals were anesthetized using methoxyflurane and blood was collected with a heparinized Pasteur pipette. Lymphocytes were stained with anti CD4-PE and anti CD8-FITC (Pharmingen) for 15 minutes. Erythrocytes were hemolyzed in lysis solution (Becton Dickinson) for 10 minutes, washed with PBS/azide solution, centrifuged and the supernatant was discarded. The pellet was fixed with 1% formalin in PBS, and stored at 4° C. until cytometry (Becton Dickinson FACS Scan; San Jose, Calif.). At the end of the three-week treatment period, blood samples were obtained and the mice were sacrificed. The lymph nodes, spleen, thymus, liver and brain tissue were collected immediately placed in 10% formalin. Following fixation and routine paraffin processing, 4 μm sections of lymph nodes were obtained after cutting randomly selected nodes through the center parallel to the long axis of the node. The slides were stained with hematoxylin and eosin (H&E) and reviewed by a pathologist that was blinded to knowledge of animal treatment groups. The presence of secondary follicles and paracortical expansion were quantitated for each animal as a percentage of lymph nodes. As medullary sinuses were not present in every lymph node profile, the presence of medullary sinus hypocellularity was quantitated as a percentage of lymph nodes which contained sinuses. In addition the approximate surface area of the cut node was computed from the product of the length and width in its maximum dimensions. The remaining tissues were examined qualitatively for pathological changes.

Figure 5B:
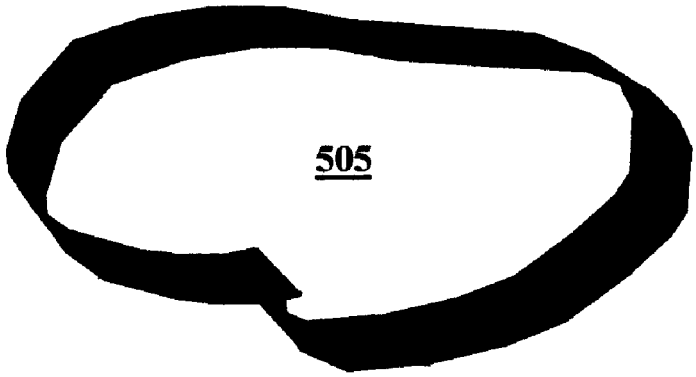
FIG. 5B represents an infected lymph node after experiencing the present treatment.

FIG. 5B represents a cross sectional slide of the lymph node taken from a mouse in the $N_2$ group. The results of the FACS analysis were significant. After the present treatment, the CD4 counts in $N_2$ and air treated animals had increased and were significantly higher than post-treatment CD4 count in control animals. The CD4 count in $O_2$ treated animals was similar to pre-treatment but significantly lower than the post-treatment control value. Post-treatment CD8 counts were unchanged from pre-treatment values except in the air treatment group, where the CD8 count increased in line with the other groups. The post-treatment CD4/CD8 ratios showed a significantly higher value in the $N_2$ group than the post-treatment control value, and the $O_2$ group showed a significantly lower ratio than the post-treatment control group.

Lymph node histology. Microscopic evaluation of lymph node architecture was used to provide qualitative information regarding changes in lymph node function. There were no significant differences in the cortex across groups as the cellularity was maintained in all nodes evaluated. The presence of secondary follicles (B cells) was evaluated quantitatively and was not significantly different across groups. The paracortex (mostly T cells) was evaluated quantitatively and was found to be expanded relative to secondary follicles in all groups. The amount of paracortex was not significantly different among treatment groups. Within medullary sinuses, however, many of the lymph nodes were hypocellular and lacked the usual population of histiocytes. On average, significantly more hypocellular sinuses were present in the control group and the $O_2$ group than in the $N_2$ and Air groups.

The study confirmed the hypothesis that utilization of nitrogen or other inert gases change lymphocyte cell membrane conformation which inhibits viral replication and stabilizes the immune system. The study also showed that hyperbaric oxygen, which has primary effects on metabolism and reactive oxygen species formation, had no beneficial effect on the murine model. Air, nitrogen and oxygen enriched gases were used at increased pressures to 72 ft for 2 hours for 6 days per week for 6 weeks. Mixtures with enriched nitrogen improved the mice physical condition, increased CD4 count ratios ($P<0.05$), and preserved lymph node architecture ($P<0.05$) after 21 days of treatment. Hyperbaric air also had a slight positive effect. Oxygen, on the other hand, showed a significant negative effect relative to control conditions ($P<0.05$). These effects are related to the nitrogen gas entering into tissues at hyperbaric pressure and its effects on the cell membrane. Because molecular nitrogen changes the conformation of cell lipid bilayers at high pressure, these findings confirm the hypothesis that inert gases at high pressure can influence the attachment of viruses to their host cell surface receptors, e.g. the CD4 molecule of T lymphocytes in the case of HIV. Further, it is suggested that the effects of saturation of cell membranes with hyperbaric nitrogen could persist for some time after a gradual decompression to normal atmospheric pressure. If intermittent nitrogen exposure reduced viral titers or viral replication, it will eventually permit normalization of CD4/CD8 counts, allowing for clinical remission.

The results of the treatment protocols were generally well tolerated by the mice. All control animals (group 1) survived the treatment period. Survival rates for the treatment protocols at 21 days were 100% for the Air (group 2) and $N_2$ (group 3) treatment groups. Two of the mice in the $O_2$ group (group 4) died during the treatment period on days 6 and 14 respectively (83% survival). Animals in the $N_2$ and hyperbaric air treatment groups showed a better grooming than animals in the control and oxygen groups. Spleen size in the $N_2$ and air treated animals was smaller by about one third than in control and oxygen treated animals. Lymph node sizes were smaller in the $N_2$ and air groups than the control and oxygen groups indicating a greater immunological stress on the control and oxygen groups. There were no significant differences by light microscopy in randomly selected sections of liver, thymus or brain, (data not shown).

It has been shown that nitrogen affects membrane fluidity (anesthetic/narcotic effect), and allows the gas to interfere with viral attachment to the cell membrane of T-lymphocytes, e.g. like many anti-viral compounds. It is further suggested that such an effect is mediated at the CD4 receptor or at viral binding sites, e.g. the hydrophobic VJ loop of gp 120 in the case of HIV, where nitrogenous moieties bind to prevent attachment.

Figure 6:
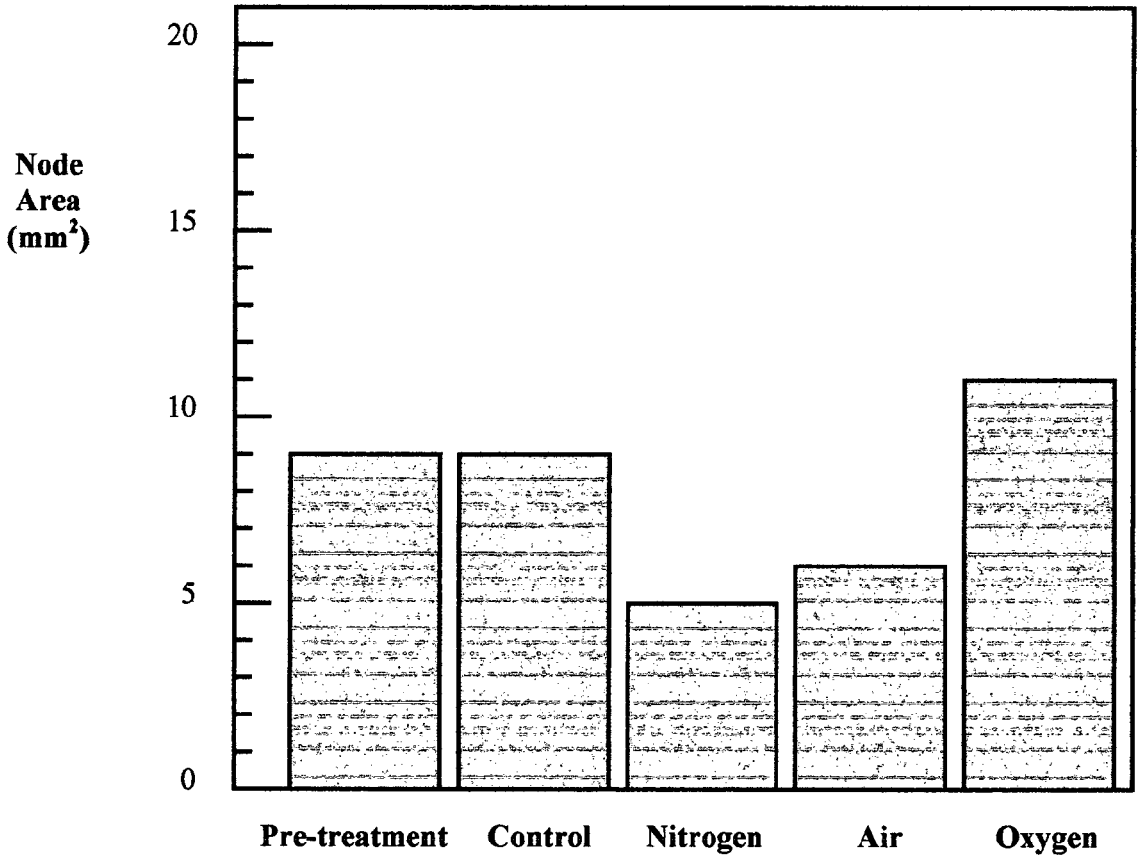
FIG. 6 is a bar chart showing the size of treated and untreated lymph nodes.

FIG. 6 is bar chart showing the average size of lymph nodes taken from the mice of different groups in the study discussed above. The lymph nodes were taken from the cervical, thoracic, and abdominal regions and fixed in 10% formalin. The nodes were then sectioned through the center of the long axis, and area was computed as the product of length times width. The chart of FIG. 6 shows a significant reduction in the size of lymph nodes taken from the mice in the nitrogen and air groups. Upon examination of the lymph nodes, the mice in the nitrogen and air groups had a reduction in the number of nodes with secondary follicles, and a reduction in the number of nodes with paracortical expansion. The mice in the nitrogen and air groups further benefited by showing an increase in the number of sinuses with histiocytes. The mice in the oxygen group actually fared worse than the control group. The oxygen treated group had a significantly lower post treatment average CD4/CD8 ratio than the control. The nitrogen treated mice showed an improved physical condition and improved lymph node architecture. The antiviral effect on these mice by raised pressures of nitrogen is suggests that a likely effect of hyperbaric nitrogen treatment of HIV infections would be a decrease of viral load. In addition, the ability of nitrogen to attenuate the damage to spleen and lymph nodes was significant.

The responses of AKR-J mice, which inherit and express leukemia proviruses, showed remarkable differences in selected indices of immune status after treatment with hyperbaric air, $N_2$ and $O_2$. AKR-J mice express a replication-competent ecotropic virus that infects T-cells and produces a recombinant virus that leads to leukemia. An anti-viral effect of hyperbaric $N_2$ on this process is suggested by the improved CD4 counts on FACS analysis and suggests that hyperbaric $N_2$ treatment could affect other retroviral infections. In addition, hyperbaric $N_2$ significantly attenuated the lymphadenopathy of MuLV. That hyperbaric $N_2$ altered cell populations of cells within lymph nodes was also demonstrated by significant differences in sinus cellularity in the $N_2$ treated versus control and $O_2$ groups. Although differences were not noted in the cellularity of cortical and paracortical areas using H&E stained sections, immunohistochemical staining and typing of lymphocyte subsets will be needed to make definitive conclusions. This study, however, provides the first direct evidence for the concept that molecular $N_2$ at hyperbaric pressure can have a positive effect on compromised cellular immunity accompanying retroviral infections.

In contrast, hyperbaric oxygen significantly decreased CD4 count and post-treatment CD4/CD8 ratio relative to control. Hyperbaric oxygen may counteract the effects of nitrogen because it displaces $N_2$, allowing it to be removed from the body. Alternatively, it may have caused membrane damage mediated by reactive oxygen species generated at high partial pressures of oxygen. Molecular oxygen can initiate lipid peroxidation and protein oxidation, leading to increased membrane fragility and decreased cellular viability. Thus, animals treated with hyperbaric oxygen may have fared worse than control animals due to cellular oxygen toxicity. Of related interest, HIV-1 expression is strongly inhibited by specific antioxidants, e.g. L-cysteine and it derivatives, and asymptomatic seropositive individuals develop intracellular glutathione depletion. The difference between $O_2$ and $N_2$ treatment also suggests that the effects of the treatment are due to molecular $N_2$ itself and not to direct effects of hydrostatic pressure independent of $N_2$. Since the mechanism is related to the narcotic effects of nitrogen on cell membranes, which is the same as that of nitrous oxide, an alternative treatment would be to expose the patients to 5-10% nitrous oxide in oxygen or air for several hours per day, for example.

Figure 7:
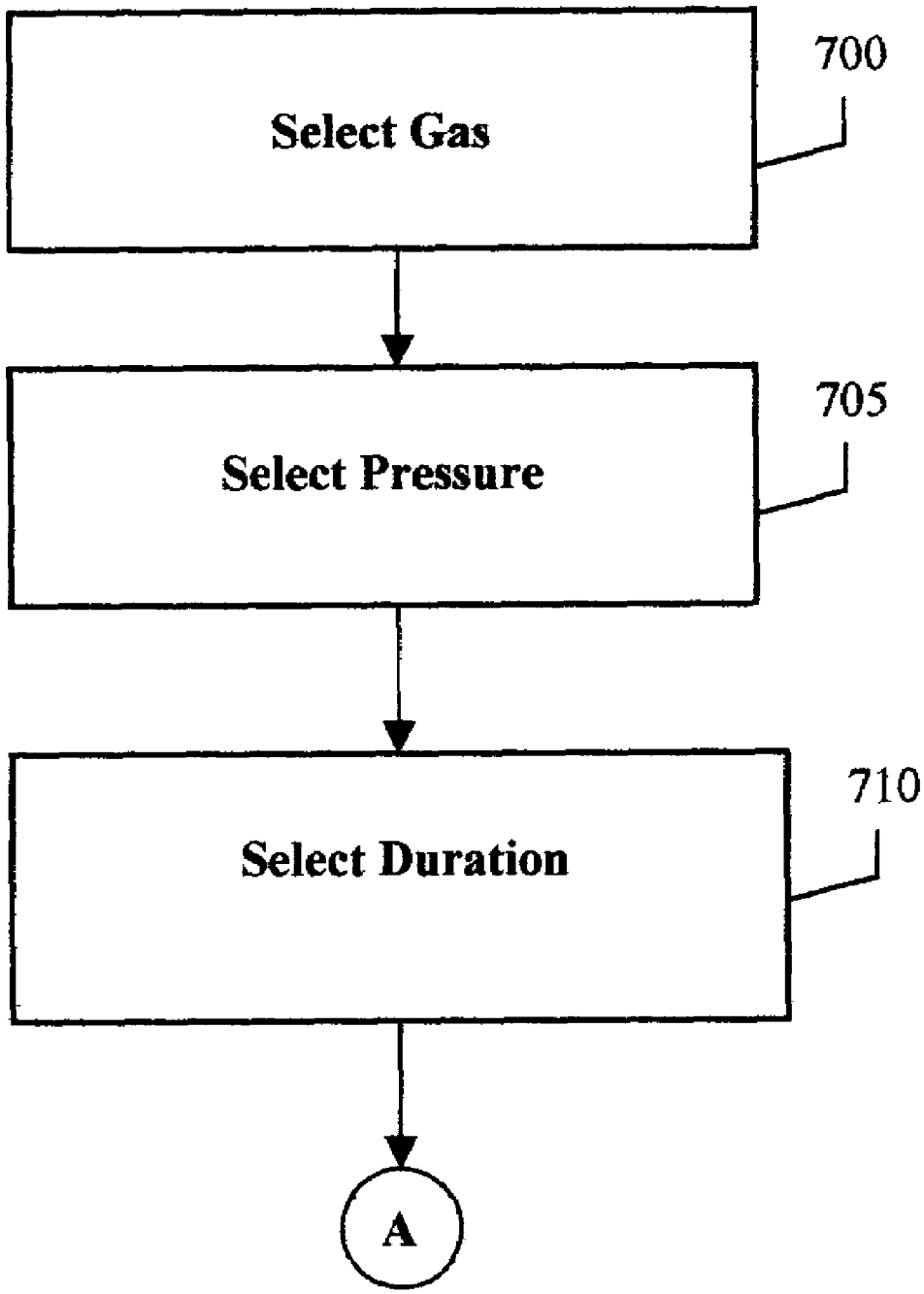
FIG. 7 is a flow chart showing the first steps of the preferred embodiment of the present treatment method.

FIG. 7 is a flow chart representing the first three steps in the preferred embodiment. In step 700, the one or more gases to be used in the hyperbaric chamber are selected. The preferred gases are a mixture of nitrogen and air, a mixture of nitrogen and oxygen, and air. Other gases that may be used include the inert gases, nitrous oxide and other anesthetics. For gases other than air, the gas preferably makes up 5% or more of the gases in the chamber. In step 705, the pressure to be used during a treatment session is selected. The selected pressure can be any pressure above 1 atm, however, is likely not to exceed 165 ft. The selected pressures may be different pressures for different sessions. The duration that is selected in step 710 dictates how long the patient will remain at the selected pressure inside a hyperbaric chamber. Total time inside the hyperbaric chamber will actually be longer than the selected duration time because of the time required to reach the selected pressure and because the of the decompression time tables that must be followed during decompression of the chamber, in order to avoid decompression sickness. The next steps are putting the above selected factors to work on a patient in a hyperbaric chamber, and are discussed with reference to FIG. 8.

Figure 8:
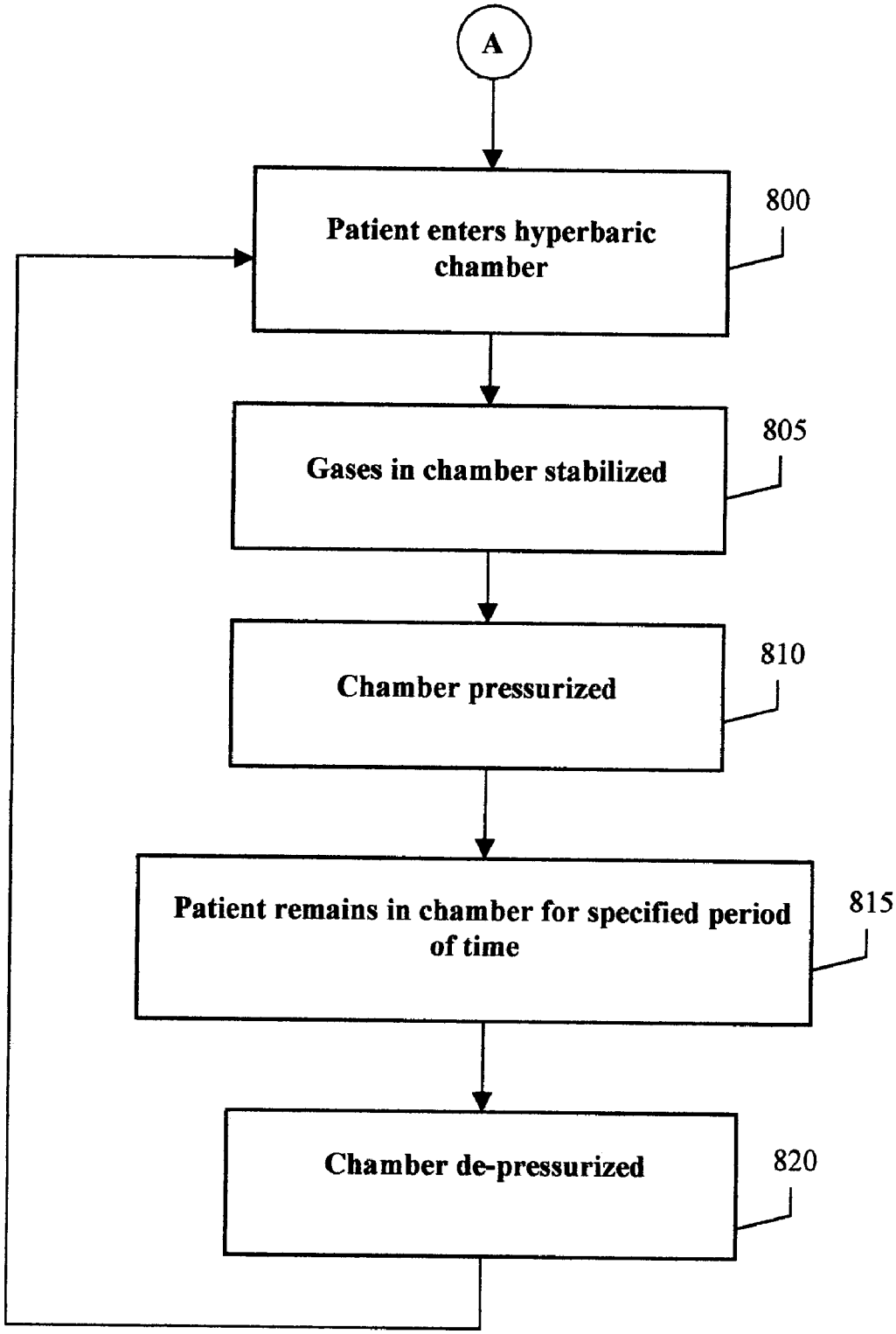
FIG. 8 is a flow chart showing exemplary remaining steps of the preferred embodiment.

FIG. 8 continues the steps of the preferred embodiment, which started on FIG. 7. In step 800, the patient, or patients in the case of larger chambers, enters the hyperbaric chamber. Once inside the chamber the patient is connected to monitoring devices that provide patient information to chamber technicians and others outside of the chamber. After the patient is connected to the monitoring devices, all non-patients leave the chamber, the chamber door is secured, and technicians begin to fill the chamber with the selected one or more gases, step 805. Preferably, testing of monitoring devices are completed during this step. In step 810, the pressure inside the chamber is raised to the pressure selected for that session. During the entire session, patient's vital signs and the composition of gas in the chamber are monitored. In step 815, the patient remains in the chamber at the selected pressure for the selected duration of time. In step 820, at the end of the selected duration of time, the chamber is decompressed according to a standard decompression timetable. These timetables, such as the U.S. Navy's decompression timetable, are well known in the art. The arrow leading from step 820 back up to step 800 in FIG. 8 represents that sessions in the hyperbaric chamber may be repeated, on a daily basis for example.

Figure 9:
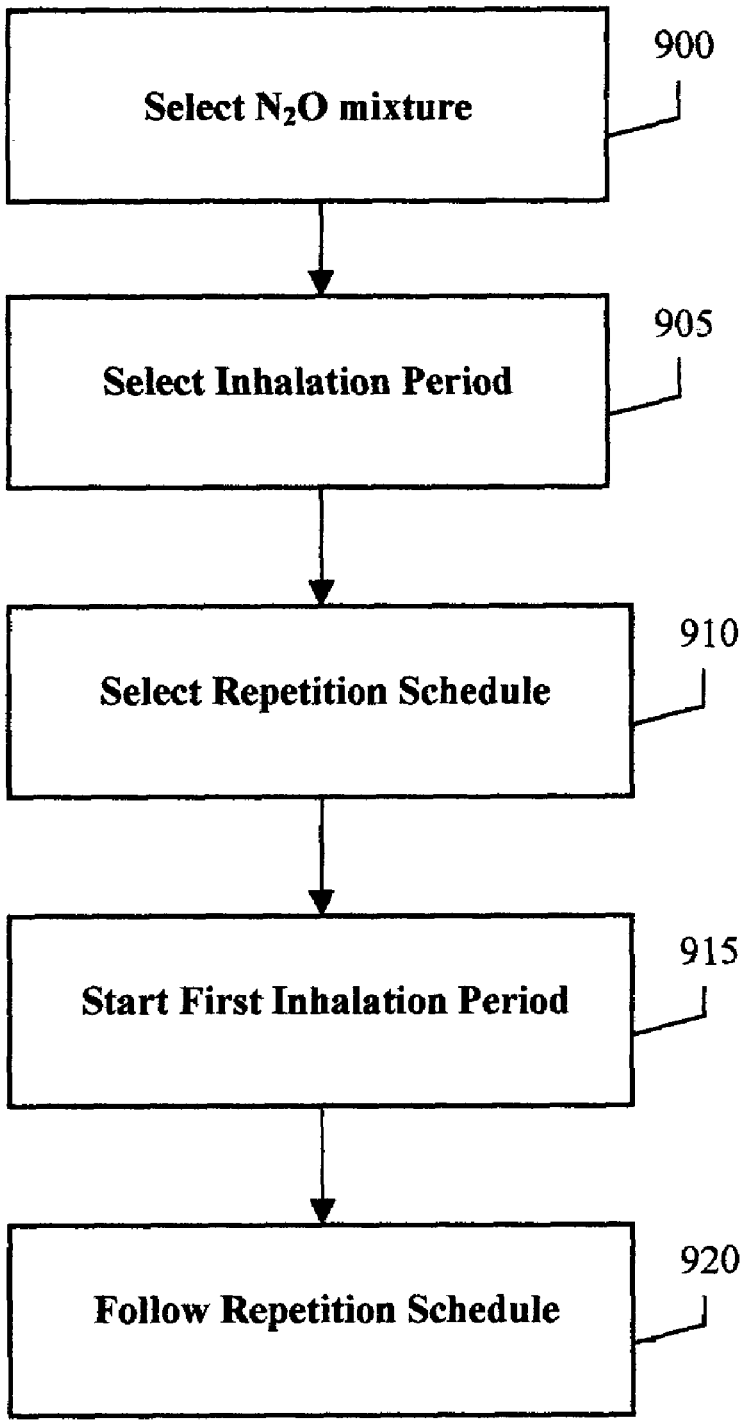
FIG. 9 is a flow chart showing the steps for an alternative embodiment of the present treatment method; and, FIG. 10 is a flow chart showing the causative agents in the present treatment.

FIG. 9 is a flow chart showing the steps for using an alternative embodiment of the present method. Since it has been noted that nitrous oxide ($N_2O$) makes a high concentration of nitrogen available to membrane layers in the human body, an alternative method that does not use a hyperbaric chamber has been established. In this alternative method, the patient inhales nitrous oxide at normal atmospheric pressure. In step 900, the percentage of nitrous oxide to be inhaled is selected in step 905, the period during which the patient will inhale the nitrous oxide is selected. In step 910, a repetition schedule that dictates the number of times to repeat inhalation sessions is prepared. Repetition of an in halation session is preferably daily and the number of repetitions may be for two days or more. In step 915, the patient begins the first inhalation period. During this step the patient inhales the selected mixture of nitrous oxide for the selected period of time, at normal pressure. In step 920, the patient continues this alternative method by following the repetition schedule. The repetition schedule will likely vary for different patients. A repetition schedule for one patient can include different percentages of nitrous oxide and different inhalation time periods.

Figure 10:
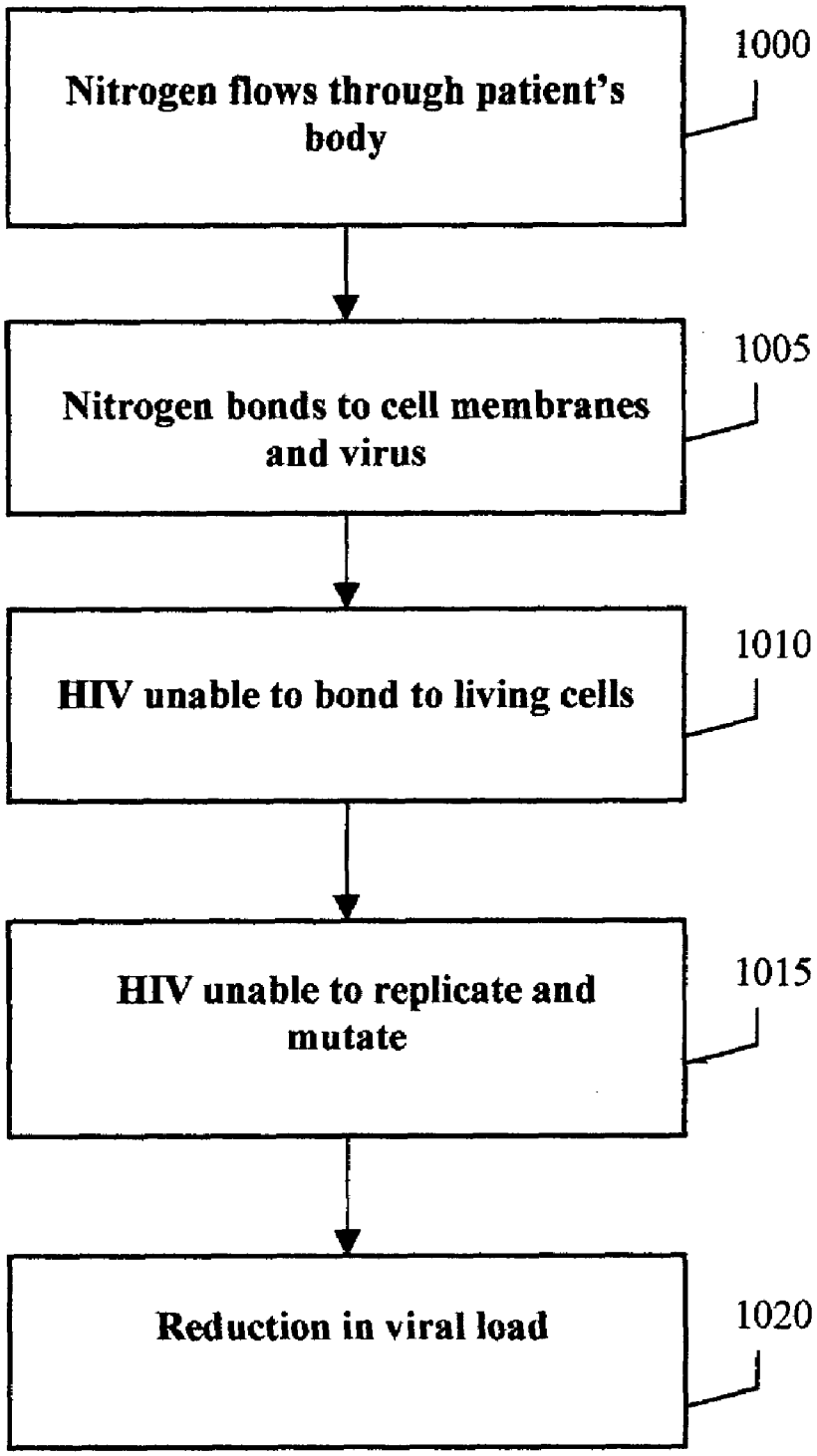

FIG. 10 is a flow chart that highlights the causative agents of the present methods. For gases such as nitrogen, nitrous oxide and air, in step 1000, nitrogen is introduced into the body when the patient breathes any of the above gases under pressure; and nitrous oxide when not under pressure. Nitrogen, which is hydrophobic, is not absorbed by the body but rather flows through the patients body. In step 1005, the nitrogen is attracted to and bonds to specific attachment sites, or receptor sites, on cell membranes of potential host cells of the virus. The nitrogen also bonds to attachment sites on the virus itself. The attachment sites that are now occupied by nitrogen are the same sites that the virus needs to attach to host cells in order to replicate. In step 1010, with the attachment sites blocked either on a host cell or on the virus, the virus is unable to attach to living cells, i.e., host cells. Since the virus is unable to attach to a host cell, the virus is prevented from replicating, step 1015. Further, since the virus only accomplishes mutation during replication, the virus is also prevented from mutating. Thus the virus is no longer able to elude the body's immune system by changing its DNA. Moreover, in the case of HIV, the preferred host cell for the virus is the body's CD4 T cell. Because of the blockage of attachment sites to CD4 T cells, this important immune system cell is not killed off and their levels rise dramatically. In step 1020, with more of the body's soldiers available to attack and kill a more easily identifiable enemy, the viral load in the patient's body is reduced.

Enriched nitrogen increased CD4/CD8 ratios with better preservation of lymph node architecture and improved physical conditions of the patient after treatment with the present method. It is therefore within the scope of this patent application that repeated exposure of AIDS patients to compressed air, nitrogen gas, or nitrogen/oxygen mixtures at pressures up to 7 atmospheres absolute (200 feet of seawater equivalent) will treat and prevent the progression of Acquired immune Deficiency Syndrome (AIDS). It is also within the scope of this application that 5-10% nitrous oxide in air breathed for periods of two or more hours daily would be equally effective as compressed air at 72 feet in preventing a fall in CD4/CD8 ratio and as a treatment for AIDS. An exemplary percentages of nitrous oxide being from 5-30% in air for periods of 2-3 hours on a continuing basis.

The foregoing description of the specific embodiments will so fully reveal the general nature of the invention that others can, by applying current knowledge, readily modify and/or adapt for various applications such specific embodiments without departing from the generic concept. Therefore, such adaptations and modifications should and are intended to be comprehended within the meaning and range of equivalents of the disclosed embodiments. It is to be understood that the phraseology of terminology employed herein is for the purpose of description and not of limitation.

I claim:

1. A method for increasing a ratio of Cd4/CD8 lymphocytes, reducing a viral load and restoring an immune system, including lymph node architecture, of a person infected with at least one virus, including HIV, wherein the person is placed in a hyperbaric chamber and exposed to one or more gases at one or more atmospheric pressures for one or more time-periods, wherein the one or more gases is nitrogen, surface air, an inert gas, nitrous oxide or another anesthetic, the method comprising the steps of:

selecting the one or more gases to be used in the hyperbaric chamber;

selecting the one or more pressures to be used in the hyperbaric chamber;

selecting the one or more time-periods that the patient is exposed to the selected gas(es) and pressure(s) while in the hyperbaric chamber;

placing the patient in, or having the patient enter, the hyperbaric chamber wherein monitoring of the patient's vital signs may optionally be provided; and, exposing the patient to the selected one or more gases, at the selected one or more pressures for the selected one or more time-periods.

2. The method of claim 1, wherein the one or more pressures selected are at least one atmosphere.

3. The method of claim 1, wherein the step of exposing the patient is repeated two or more times.

4. The method of claim 1, wherein the one or more pressures selected are equal to an underwater pressure of between 70 and 165 feet.

5. The method of claim 1, wherein the duration of exposure is repeated daily for 3 to 21 days.

6. The method of claim 1, further comprising the step of:

creating an exposure chart for the person wherein the chart lists the time-periods the person is to be exposed to the selected one or more pressures and selected one or more gases, and wherein the exposure chart is at least partly based on a condition of the person.

7. The method of claim 1, wherein the step of placing the patient in the chamber further comprises:

placing more than one person in the chamber.

8. The method of claim 1, further wherein when the one or more gases are nitrogen, an inert gas, nitrous oxide or another anesthetic gas, the one or more gases make up 5% or more of the gases in the chamber.

9. A method for preventing reproduction of a virus wherein a pressurized chamber is used to cause an atom, molecule or compound from gases that fills the chamber, or from within a patient's body, into an attachment site on a cell wall of a living cell or into a receptor unit on the virus, whereby the atom, molecule or compound prevents the virus from replicating by preventing the virus from attaching to the attachment site of the living cell, the method comprising the steps of:

selecting one or more gases to be used inside the chamber, wherein the one or more gases are nitrogen, surface air, an inert gas, nitrous oxide or another anesthetic;

selecting one or more pressures to expose the patient to while inside the chamber;

selecting one or more time-periods, wherein each time-period is associated with a selected pressure; and, exposing the patient to the one or more selected gases in the chamber at a selected pressure for the associated time-period.

10. The method of claim 9, wherein the step of exposing the patient is repeated two or more times.

11. The method of claim 9, wherein the one or more selected pressures are at least one atmosphere.

12. The method of claim 9, wherein more than one patient is placed in the chamber and the more than one patients are simultaneously exposed to the gases and pressures inside the chamber.

13. The method of claim 9, wherein the patient remains at the selected pressure for the selected time-period and the patient is subsequently returned to normal atmospheric pressure (1 ata) during a decompression time and wherein the decompression time is at least partly based on a standard decompression table.

14. The method of claim 9, further wherein when the one or more gases are nitrogen, an inert gas, nitrous oxide or another anesthetic gas, the one or more gases make up 5% or more of the gases in the chamber.

* * * * *